US006915553B2

(12) United States Patent
Turner et al.

(10) Patent No.: US 6,915,553 B2
(45) Date of Patent: Jul. 12, 2005

(54) SEAMING APPARATUS AND METHOD FOR CANS

(75) Inventors: Timothy L. Turner, Pecatonica, IL (US); Randall G. Forrest, Park Ridge, IL (US); Michael R. Gogola, Arlington Heights, IL (US)

(73) Assignee: Rexam Beverage Can Company, Chicago, IL (US)

( * ) Notice: Subject to any disclaimer, the term of this patent is extended or adjusted under 35 U.S.C. 154(b) by 209 days.

(21) Appl. No.: 10/370,010

(22) Filed: Feb. 19, 2003

(65) Prior Publication Data

US 2004/0159697 A1 Aug. 19, 2004

(51) Int. Cl.[7] ..... B23P 11/00; B21D 51/30

(52) U.S. Cl. ..... 29/505; 29/509; 29/510; 29/511; 29/243.5; 413/4; 413/6; 413/26; 413/27; 72/379.4

(58) Field of Search ..... 29/505, 506, 509, 29/510, 511, 243.5, 281.4; 220/169, 615, 623, 619; 72/348, 379.4; 413/4, 6, 26, 27, 31

(56) References Cited

U.S. PATENT DOCUMENTS

| | | | | |
|---|---|---|---|---|
| 2,700,355 A | | 1/1955 | Erb | 113/120 |
| 3,409,168 A | | 11/1968 | Chmielowiec | 220/67 |
| 3,715,054 A | * | 2/1973 | Gedde | 220/619 |
| 3,757,716 A | * | 9/1973 | Gedde | 413/56 |
| 3,957,005 A | | 5/1976 | Heffner | 113/1 F |
| 4,031,837 A | | 6/1977 | Jordan | 113/121 |
| 4,102,467 A | | 7/1978 | Woodley | 220/67 |
| 4,217,843 A | | 8/1980 | Kraska | 113/121 |
| 4,697,972 A | | 10/1987 | Le Bret et al. | 413/6 |
| 4,784,282 A | | 11/1988 | Le Bret et al. | 220/67 |
| 4,820,100 A | | 4/1989 | Riviere | 413/6 |
| 5,582,319 A | | 12/1996 | Heyes et al. | 220/454 |

(Continued)

FOREIGN PATENT DOCUMENTS

| | | |
|---|---|---|
| EP | 0177426 A1 | 10/1987 |
| EP | 0227213 B1 | 6/1990 |
| EP | 227213 A2 | 9/1996 |
| GB | 2288759 A1 | 11/1995 |

OTHER PUBLICATIONS

Reynolds Metals Company, Double Seam Manual, 22 pages (1971).

*Primary Examiner*—Essama Omgba
(74) *Attorney, Agent, or Firm*—McDonnell Boehnen Hulbert & Berghoff LLP

(57) ABSTRACT

Seaming apparatus and method for seaming ends to cans are described. The seaming apparatus includes a seaming chuck received by the can end. The chuck includes an anvil portion and a peripheral upper anvil wall. The upper anvil wall is inclined at an angle α of greater than or equal to 6 degrees. The seaming apparatus also includes a seaming roll having a seaming surface for engaging the peripheral curl of the can end in a seaming operation to compress the peripheral curl against the peripheral flange and the peripheral upper anvil wall of the seaming chuck. The seaming surface of the seaming roll is inclined relative to the longitudinal axis by an angle β. The value of β is selected to be greater than about 4 degrees, and more preferably from between about 8 and about 14 degrees. Additionally, the value of β bears a close approximate relationship to the value of α, and in particular the value of angle β=α±up to about 4 degrees.

21 Claims, 6 Drawing Sheets

U.S. PATENT DOCUMENTS 5,595,322 A * 1/1997 Kramer ..... 220/619
5,915,587 A * 6/1999 Kramer ..... 220/619
5,971,259 A 10/1999 Bacon ..... 229/5.6
6,065,634 A 5/2000 Brifcani et al. ..... 220/619
6,089,072 A 7/2000 Fields ..... 72/379.4
6,102,243 A 8/2000 Fields et al. ..... 220/619
6,408,498 B1 6/2002 Fields et al. ..... 29/243.5
6,419,110 B1 7/2002 Stodd ..... 220/623
6,425,493 B1 7/2002 Gardiner ..... 220/733
6,425,721 B1 7/2002 Zysset ..... 413/8
6,428,261 B1 8/2002 Zysset ..... 413/8
6,460,723 B2 10/2002 Nguyen et al. ..... 220/619
6,499,622 B1 * 12/2002 Neiner ..... 220/619
6,516,968 B2 * 2/2003 Stodd ..... 220/623
6,561,004 B1 * 5/2003 Neiner et al. ..... 72/715
6,736,283 B1 * 5/2004 Santamaria et al. ..... 220/619
2001/0037668 A1 11/2001 Fields ..... 72/348
2002/0134788 A1 9/2002 Nguyen et al. ..... 220/624
2002/0139805 A1 10/2002 Chasteen et al. ..... 220/623
2002/0158071 A1 10/2002 Chasten et al. ..... 220/269

* cited by examiner

SEAMING APPARATUS AND METHOD FOR CANS

BACKGROUND OF THE INVENTION

A. Field of the Invention

This invention relates to the can manufacturing art, and more particularly to a novel construction and arrangement of the tooling that is used to form the seam joining a can end to a can body.

B. Description of Related Art

It is well known to draw and iron a sheet metal blank to make a thin-walled can body for packaging beverages, such as beer, fruit juice or carbonated beverages. In a typical manufacturing method for making a drawn and ironed can body, a circular disk or blank is cut from a sheet of light gauge metal (such as aluminum). The blank is then drawn into a shallow cup using a cup forming punch and die equipment. The cup is then transferred to a body maker or can forming station. The body maker draws and irons the sidewalls of the cup to approximately the desired height and forms dome or other features on the bottom of the can. After formation of the can by the body maker, the top edge of the can is trimmed. The can is transferred to a necking station, where neck and flange features are formed on the upper region of the can. The flange is used as an attachment feature for permitting the lid for the can, known as an "end" in the art, to be secured to the can.

The end is the subject of a different manufacturing process and involves specially developed machines and systems to manufacture such ends in mass quantities. After the ends are formed, they are sent to a curling station where a peripheral curl is provided to the end. As will be discussed below, the peripheral curl is used in a seaming operation to join the can end to the can body. After curling, the ends are sent in stick form to a compound liner station. A water-based compound sealer is applied to the ends in the compound liner station. From there the ends are fed to an inspection station and to a dryer station where the compound is subjected to heated forced air to dry the compound. If a solvent-based compound is used, then no drier is needed. The ends are then placed in stick form, bagged, and then loaded on pallets for shipping.

The preservation of the contents of the can requires the formation of hermetic seal between the end and the can body. The can must also resist internal and external pressures. These internal pressures include the pressure due to carbon dioxide gas contained in carbonated beverages, beer and the like. These pressures must be contained by the seam or joint attaching the can end to the can body. Generally speaking, most bottlers require that the seam must withstand an internal pressure of 90 PSI (pounds per square inch), although some require more. Furthermore, the seam must prevent the leakage of gas from the container. Today, the hermetic seal between the can end and the can body is typically formed as a result of a process known in the art as double-seaming. In this process, the can end peripheral curl and can body flange are held together, interlocked, curled, and roll-pressed to form a hermetic seal.

The double seaming operation uses two successive seaming operations, a first operation using a first seaming roll and a second operation using a second seaming roll. The process is illustrated in FIGS. 1A–1D. In the first operation, the end 10 and can body 12 are clamped together between a lifter mechanism (not shown) and a seaming chuck 14. The seaming chuck has a configuration profiled to fit within the can end, generally within the countersunk portion 16 of the end 10. The seaming chuck 14 includes an anvil portion 18 and an upper peripheral wall 20 that supports the flange 22 of the can body as shown in FIG. 1C. The can body 12 and end 10 rotate at high speed about the longitudinal axis of the can body while a first seaming roll 24 is moved into contact and brought to bear with a steady pressure against the peripheral curl 32 of the can end 10, as shown in FIG. 1C. The first-operation seaming roll 24 is mounted on a bearing which, when the roll 24 is pressed against the peripheral curl, allows the roll 24 to freely roll in a counter-rotational direction as the can body and can end are rotated about the longitudinal axis of the can body.

The upper face 26 of the first-operation seaming roll 24 just clears the top lip 30 of the seaming chuck 14. As the roll 24 presses against the end's curl 32, the flange 22 of the can bends over to form a body hook 34. The curl 32 of the end tucks underneath and behind the body hook 34 to form the cover hook 36.

The function of the second-operation roll 40 is to complete the seam formation. It does so by compressing the cover hook 36 and body hook 34 tightly against the anvil of the chuck 14, so that the two interlock tightly, as shown in FIG. 1D. The gaps between the two are filled with the sealing compound originally placed inside the curl of the end 10. The result is a strong, leak-proof seal between the can body and the end.

Can end manufacturers are continuously striving to reduce the amount of metal used to form the can ends. Currently, such efforts include can ends made of thinner gauge metal, and designing the ends with larger inclination angles between the chuck wall of the can end and the longitudinal axis. One such can end is described in Brifcani, et al., U.S. Pat. No. 6,065,634, an example of which is shown in FIG. 2A. In the '634 patent, the chuck wall 42 is said to be inclined at an angle of between 40 and 60 degrees. When the end of the '634 patent is double seamed to a can body using existing seaming equipment, this chuck wall is constrained to be inclined at a 4 degree angle relative to the longitudinal axis, plus some small additional angle due to springback of the chuck wall 42 after double seaming. This is because conventional seaming chucks typically have an upper anvil wall angle of 4 degrees to vertical, as shown in FIG. 1B. The present inventors have observed that for cans ends with relatively large chuck wall angles (greater than say 25 degrees), this large an angle for the chuck wall tends to produce a seam gap and a resulting force F between the can end and the can body that has a tendency to un-do, or weaken, the double seam, as indicated by the arrow in FIG. 2B. Such a gap and associated weakening of the seam also has a tendency to reduce the buckle strength of the can end. In particular, the buckle strength (i.e., the limit at which the double seam fails) can fall below the minimum level that is acceptable.

FIG. 3 is a cross-sectional view of a prior art second seaming roll 40 showing an arcuate seaming profile. The seaming roll has a seaming surface 52 that contacts the curl of the end as shown in FIG. 1D, and an upper face 26 that clears the top surface 30 of the chuck, and a radius R1 that connects the seaming surface 52 at its upper edge 54 to the face 26. The lower edge 56 of the seaming surface 52 is connected to a radius R2 that supports the lower curl edge 58 of the double seam, as shown in FIG. 1D. In accordance with the definitions of the incline or slant angle of the seaming surface described below, the seaming surface 52 of the standard prior art roll is inclined slightly, at a 2 degree angle. This angle is determined by constructing a chord 60 that connects the upper and lower edges 54 and 56, and measuring the angle β between this chord and a line 62 parallel to the longitudinal axis of the can body. Line 62 is also parallel to the axis of the seaming roll 40 and parallel to the axis of revolution of the can body and end during the double seaming. R1 and R2 can be anything as long as they are tangent to the seaming surface at the upper and lower edges thereof (i.e., so that a continuous surface is formed for R1, R2 and the seaming surface 52). Chord 60 is only relevant from the standpoint of providing an analytical technique for determining the vertical inclination of the seaming roll, in accordance with this invention.

The present invention provides improved seaming apparatus and methods that provide improved buckle strength in the double seam. While not necessarily so limited, the invention is particularly advantageous in the seaming can ends in which the chuck wall of the can end is inclined relative to the longitudinal axis at relatively large angles prior to seaming, such as angles of between 20 and 60 degrees.

SUMMARY OF THE INVENTION

In a first aspect, an apparatus is provided for forming a seam joining a can end to a can body. The can end has a peripheral curl. The can body defines a longitudinal axis and has a peripheral flange for engagement with the peripheral curl during the seaming operation, as is conventional in the art.

The seaming apparatus includes a seaming chuck that is received by the can end when the can end is placed over the can body to join the can body and can end together during the seaming operation. The chuck includes an anvil portion and a peripheral upper anvil wall. Whereas in the prior art the upper anvil wall was typically inclined relative to the longitudinal axis at an angle α of 4 degrees or less, in this invention it is inclined at an angle α of greater than 6 degrees.

The seaming apparatus also includes a seaming roll having a seaming surface for engaging the peripheral curl in a seaming operation to compress the peripheral curl against the peripheral flange and the peripheral upper anvil wall of the seaming chuck. In a double seaming embodiment, the seaming roll being referred to herein is the second seaming roll.

The seaming surface of the seaming roll is inclined relative to the longitudinal axis by an angle β. The value of β is selected to be greater than about 4 degrees, and more preferably from between about 8 and about 14 degrees. Additionally, the value of β bears a close approximate relationship to the value of α, and in particular the value of angle β=α±up to about 4 degrees.

The invention is particularly advantageous for use with can ends in which the chuck wall is inclined at angle of at least 20 degrees from the vertical, for example in the range of 20–60 degrees. More typical ranges for the inclination angles are between 25 and 50 degrees. For such ends, the seam roller and chuck anvil will typically take on an inclination angle of between 6 and 15 degrees.

Furthermore, the seaming roll and anvil are configured and arranged so as to form a seam that is not too tight so as to cause a thinning of the metal in the can body at the seam, as thinning of the can body decreases buckle strength. Looser seams (while still tight enough to prevent a leaker) tend to produce better results in terms of greater buckle strength. Such seams, with the matching chuck anvil and seam roll angles as described herein, along with the substantially inclined chuck walls in the end (greater than 20 degrees), tend to form better seams with less bending of the chuck wall, and less springback in the metal which would tend to form a seam gap and weaken the buckle strength of the can end. A tight seam takes the can body wall and thins it down, because the end stock material is harder than the can stock material. For the illustrated embodiments, a seam thickness of between 46 and 47 thousandths of an inch would indicate a "loose seam", whereas a seam thickness of less than 42 thousands would indicate a "tight" seam where some metal thinning would be expected.

It has been found that with the values of α and β as set forth, and the roll and chuck arranged so as to not form a seam that is too tight, an improved double seam is performed which has significantly improved buckle strength, i.e., a resistance to buckling of the seam due to the pressure from the contents of the can. As such, the seaming operation improves the double seam for some of the more recent can end designs that feature more highly inclined chuck walls. The apparatus is also particularly advantageous in the seaming of ends to aluminum beverage cans, such as cans used for containing beer, fruit juice, carbonated beverages, and the like.

Preferred embodiments of the invention are described below in which the value of α is between 6 and 14 degrees and the value of β is between 8 and 14 degrees. In preferred embodiments β≧α, and β and α are within 3 degrees of each other.

In another aspect, a method is provided for joining a can body to a can end. The method includes the step of placing the can end over the can body and receiving a seaming chuck in the can end. The chuck has an anvil portion and a peripheral upper anvil wall. The upper anvil wall is inclined relative to the longitudinal axis of the can body at an angle α greater than 6 degrees. The method continues with a step of performing a seaming operation on the can end and can body with a seaming roll. The seaming roll has a seaming surface for engaging the peripheral curl in a seaming operation to compress the peripheral curl against the peripheral flange and peripheral upper anvil wall to form a seal between the can end and the can body. The seaming surface and the upper anvil wall of the chuck are constructed and arranged such that the seaming surface is inclined relative to the longitudinal axis by an angle β, wherein β is greater than about 4 degrees, and wherein β=α±up to about 4 degrees.

In a related aspect, a seaming roller is provided which has a seaming surface which roll is inclined relative to the longitudinal axis of the can body by an angle β. The value of β is selected to be greater than about 4 degrees, and more preferably from between about 8 and about 14 degrees.

In a further related aspect, a seaming chuck is provided that is received by a can end when the can end is placed over the can body to join the can body and can end together during the seaming operation. The chuck includes an anvil portion and a peripheral upper anvil wall. Whereas in the prior art the upper anvil wall was typically inclined relative to the longitudinal axis at an angle α of 4 degrees or less, in this invention it is inclined at an angle α of greater than 6 degrees, and in representative embodiments inclined at an angle of between 6 and 15 degrees.

BRIEF DESCRIPTION OF THE DRAWINGS

A presently preferred embodiment of the invention is described below in conjunction with the drawings, in which like reference numerals refer to like elements in the various views, and in which:

in FIG. 4 the seam chuck anvil angle $\alpha$ of 10 degree can vary somewhat, as can the inclination or tilt angle $\beta$ of the seaming surface of the seaming roll, however the angles $\alpha$ and $\beta$ are preferably within a few degrees of each other. In FIG. 4, $\beta$=12 degrees.

FIGS. 6A–6E are views showing how the seaming surface may be rotated about a point proximate to the lower end of the seaming surface from an original configuration by 2, 4, 6, 8, and 12 degrees, respectively, to thereby incline the seaming surface by an amount $\beta$. The resulting angle $\beta$ is equal to the rotation angle R plus the inclination of the seaming surface in the original configuration (here, 2 degrees). FIG. 6E also shows two possible methods for measuring the seaming surface inclination angle $\beta$.

DETAILED DESCRIPTION OF THE PREFERRED EMBODIMENTS OF THE INVENTION

Figure 4:
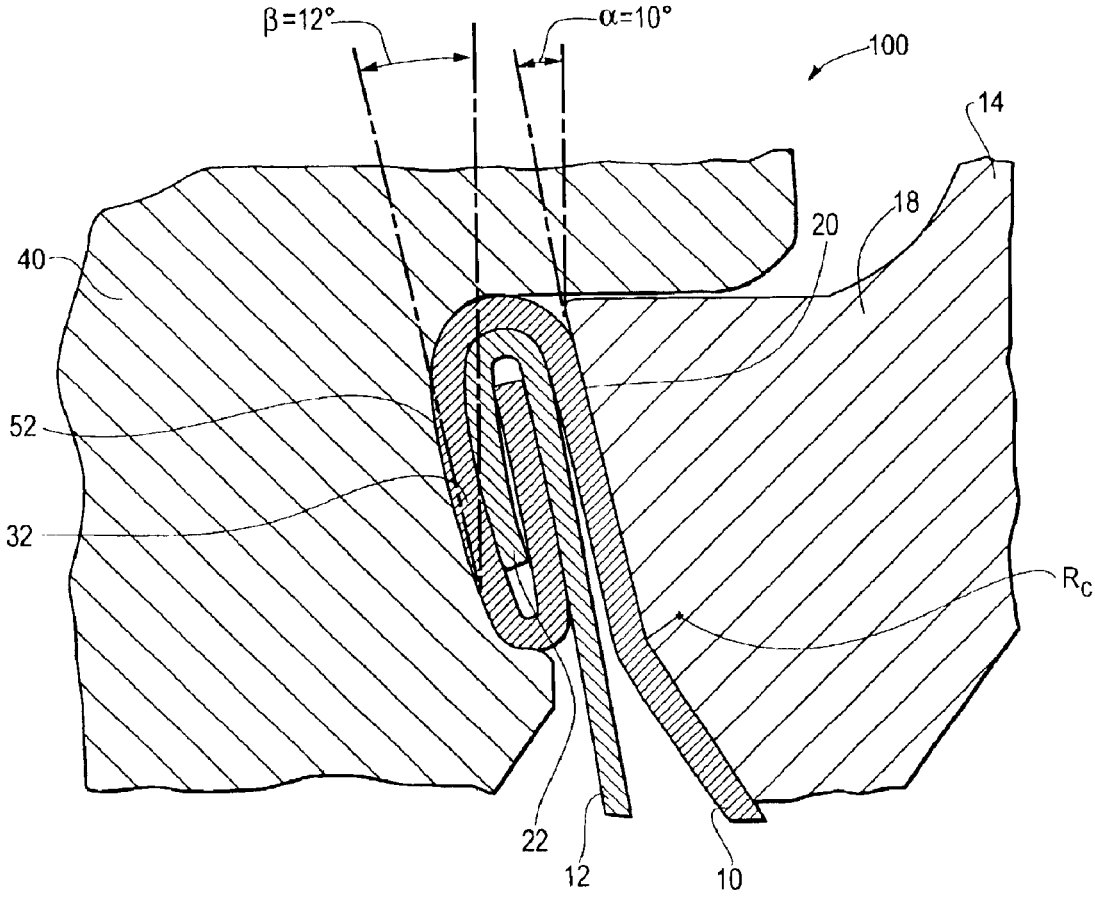
FIG. 4 is an illustration of the tooling used to form a second seam in accordance with one embodiment of the invention.

Improved seaming apparatus is described below which increases the buckle strength of the double seam. FIG. 4 is an illustration of the tooling used to form a second seam in accordance with one embodiment of the invention. The seaming apparatus 100 includes a seaming chuck 14 that is received by the can end 10 when the can end 10 is placed over the can body 12 to join the can body 12 and can end 10 together during the seaming operation. The chuck includes 14 an anvil portion 18 and a peripheral upper anvil wall 20. Whereas in the prior art the upper anvil wall 20 was typically inclined relative to the longitudinal axis at an angle $\alpha$ of 4 degrees or less, or even at a negative angle (tilted towards the longitudinal axis), in this invention it is inclined at an angle $\alpha$ of greater than or equal to 6 degrees. In the embodiment shown in FIG. 4, the angle $\alpha$ is 10 degrees.

The seaming apparatus also includes a seaming roll 40 having a seaming surface 52 for engaging the peripheral curl 32 in a seaming operation to compress the peripheral curl 32 against the peripheral flange 22 and the peripheral upper anvil wall 20 of the seaming chuck 14. In a double seaming embodiment, the seaming roll being referred to herein is the second seaming roll.

The seaming surface 52 of the seaming roll is inclined relative to the longitudinal axis by an angle $\beta$. The seam chuck anvil angle $\alpha$ of 10 degrees can vary somewhat, as can the inclination or tilt angle $\beta$ of the seaming surface of the seaming roll, however the angles $\alpha$ and $\beta$ are preferably within a few degrees of each other. The value of $\beta$ is selected to be greater than or equal to about 4 degrees, and more preferably from between about 8 and about 14 degrees, and most preferably from between about 10 and 13 degrees. In FIG. 4, the value of $\beta$ is 12 degrees. Additionally, the value of $\beta$ bears a close approximate relationship to the value of $\alpha$, and in particular the value of angle $\beta=\alpha\pm$up to about 4 degrees. In some embodiments $\beta \geqq \alpha$, and $\beta$ and $\alpha$ are within 3 degrees of each other.

It has been found that with the values of $\alpha$ and $\beta$ as set forth, an improved double seam is performed which has significantly improved buckle strength, i.e., a resistance to buckling of the seam due to the pressure from the contents of the can. As such, the seaming operation improves the double seam for some of the more recent can end designs that feature more highly inclined chuck walls. The apparatus is also particularly advantageous in the seaming of aluminum ends to aluminum or steel beverage cans, such as cans used for containing beer, fruit juice, carbonated beverages, and the like.

The seaming surface 52 on the seaming roller may take a variety of forms. In one possible embodiment, the seaming surface 52 has a frusto-conical form with a straight cross-sectional profile. In this embodiment, the inclination of the seaming roller ($\beta$) is simply the angle between the seaming surface and the longitudinal axis. In other embodiments, the seaming surface may be a curved surface, such as an arc forming a section of a circle. This is shown for example in FIG. 4. In the arcuate embodiments, there are several possible methods for measuring the overall inclination angle $\beta$ of the seaming surface. In one method, and with reference to FIG. 5, the cross-sectional profile of the curved or arcuate seaming surface 52 has upper and lower peripheral points 54, 56, respectively at which the curved surface 52 transitions to adjacent surfaces R1 and R2 of the seaming roll. The measurement of the inclination of the seaming surface is performed by constructing a chord 60 on the profile connecting the upper and lower points 54 and 56, and measuring the inclination of the chord 60 relative to the longitudinal axis 62.

Figure 3:
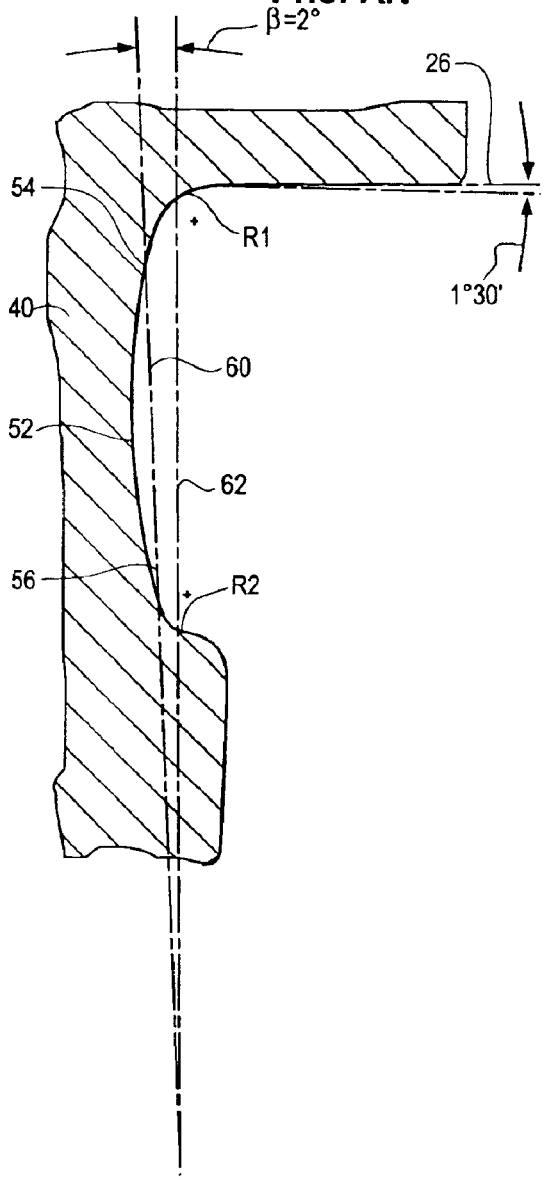
Fig. 3 Prior Art
FIG. 3 is a more detailed view of the profile of a second seaming roller known in the art.
Figure 2B:
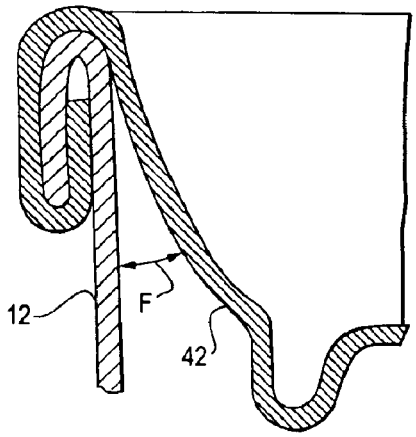
Fig. 2B Prior Art
FIG. 2B is an illustration of a seam gap and resulting spreading force F that can result when can ends such as shown in FIG. 2A are double seamed using conventional seaming chucks with a 4 degree angle between the upper wall and the longitudinal axis.
Figure 5:
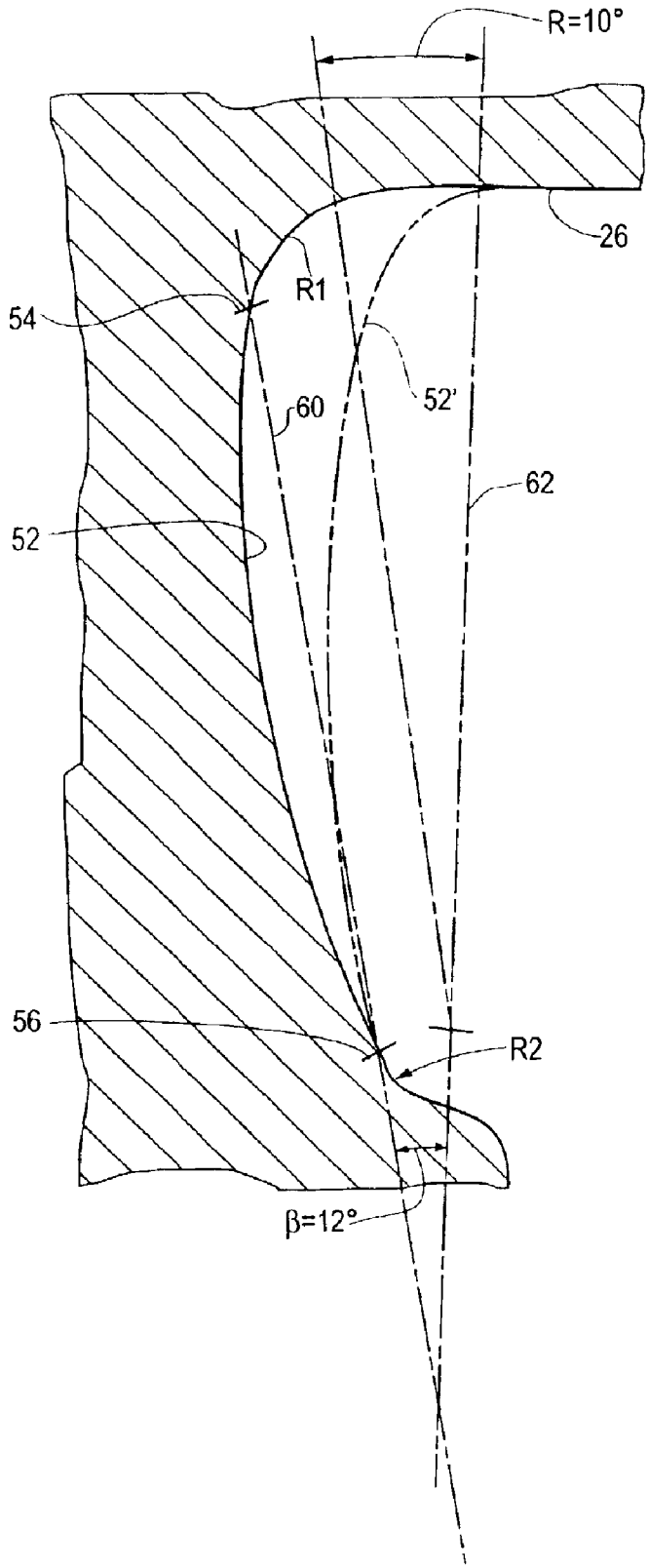
FIG. 5 is a more detailed illustration of the seaming roller of FIG. 4, showing one way of producing the seaming surface inclination angle $\beta$ by rotation of the surface from its original configuration about a point by a rotation angle R.

There are several possible alternative methods of arriving at the inclination of a curved seaming surface 52. As shown in FIG. 5, the inclination of the seaming surface 52 is formed by constructing an arc 52' having the same profile in a first orientation (shown in dashed lines) and rotating the arc 52' about the lower peripheral point 56 by a rotation angle R. In the example of FIG. 5, the rotation angle R is 10 degrees. The original configuration of the profile 52' is the original profile of the prior art roller shown in FIG. 3. Since the original profile 52' has a 2 degree inclination, and the rotation is 10 degrees, the resulting angle $\beta$ is the sum of these two values, or 12 degrees. The same result can be obtained by a 10 degree rotation about the center of curvature and then translation of the curve up and over so that that it is continuous with the lower radius R2, and upper radius is moved over to be continuous with the top of the seaming profile at the top of the chord.

The seaming roll is then formed (i.e., machined) with the curved seaming surface 52 according to arc 52', as rotated. The inclination of the seaming surface can also be measured by constructing a chord 60 on the profile and measuring the inclination of the chord 60 relative an axis 62 parallel to the longitudinal axis of the can body as described above.

FIGS. 6A–6E are views showing how the seaming surface may be rotated about a point proximate to the lower edge 54 of the seaming surface from an original configuration by 2, 4, 6, 8, and 12 degrees, respectively, to thereby incline the seaming surface by an amount β. The resulting inclination β is equal to the rotation angle R plus the inclination of the seaming surface in the original configuration at 52' (here, 2 degrees). While the rotation is shown about the center of curvature 72 of the radius R2, the rotation could be taken about any convenient point proximate to the lower edge 56 including the point 56 itself.

Figure 6A:
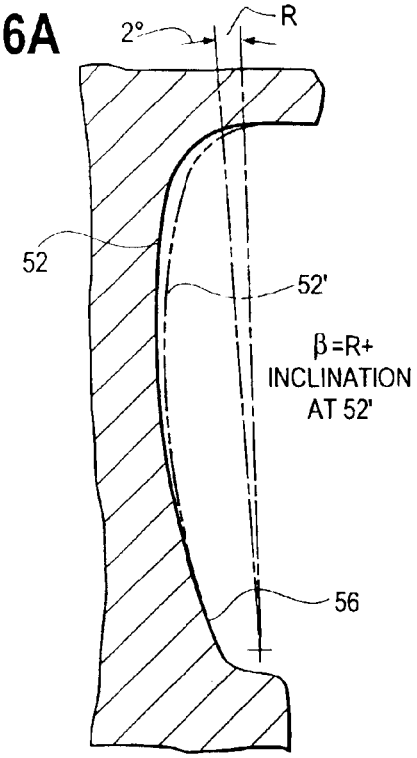
Figure 6B:
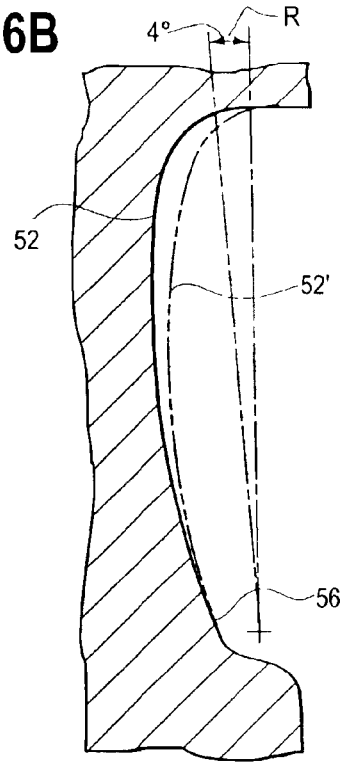
Figure 6D:
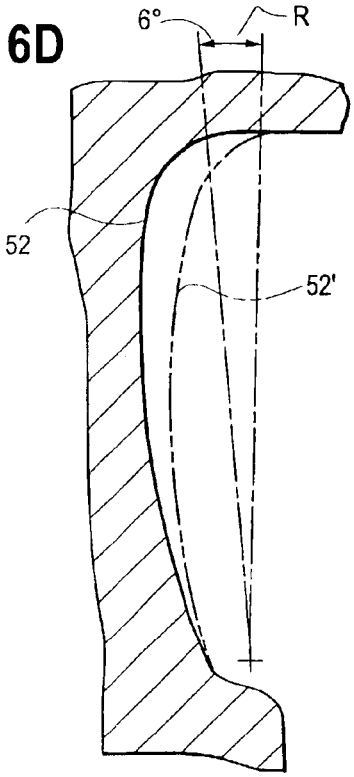
Figure 6D:
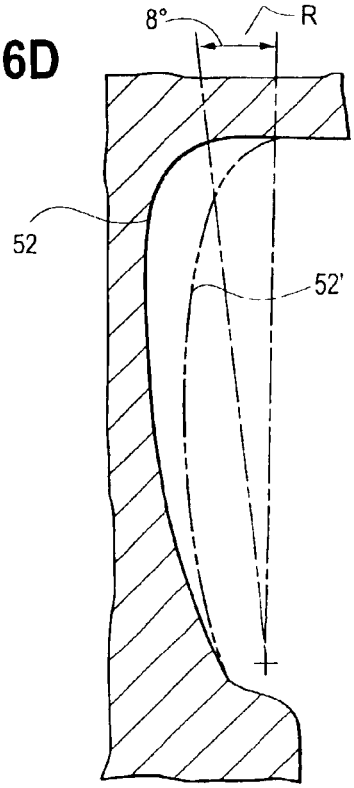
Figure 6E:
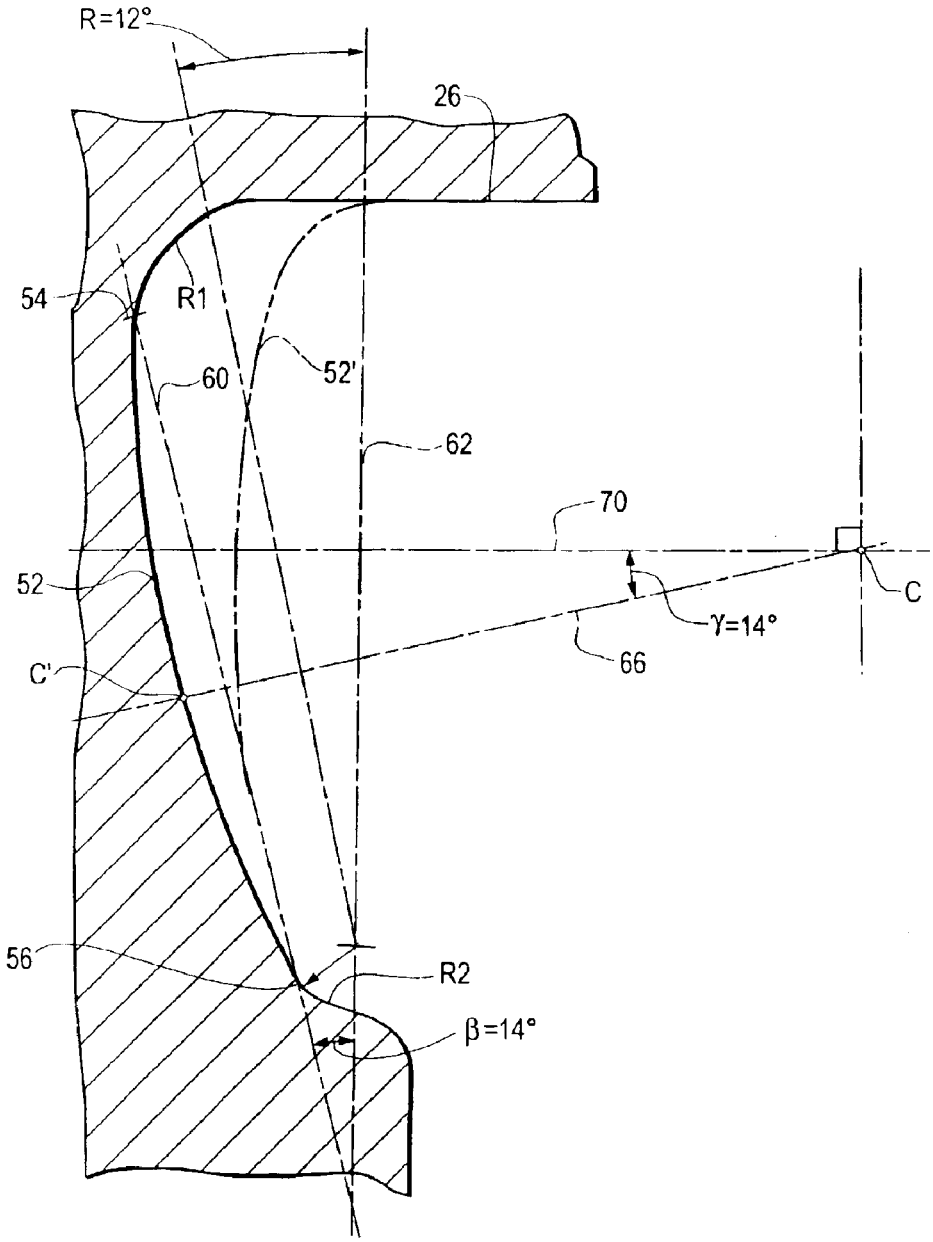

FIG. 6E also shows another method for measuring the seaming surface inclination angle β. The measurement of the inclination of the seaming surface could be performed by constructing a line 66 from the center of curvature C of the curved seaming surface to the midpoint C' of the surface 52 and measuring the angle γ between that line (66) and a second line 70 extending from the center of curvature C that intersects the profile 52 and which is perpendicular to the longitudinal axis 62. Here, in FIG. 6E, β=γ=14 degrees.

Figure 1A:
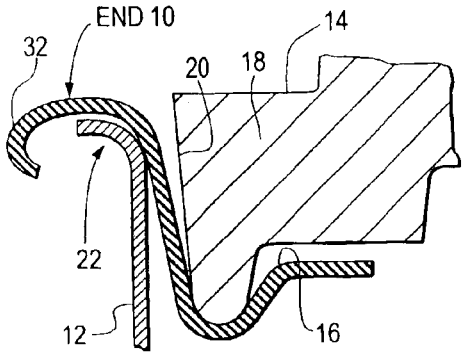
Fig. 1A Prior Art
FIGS. 1A–1D are an illustration of a prior art method arrangement for forming a double seam of a can end to a can body.
Figure 1B:
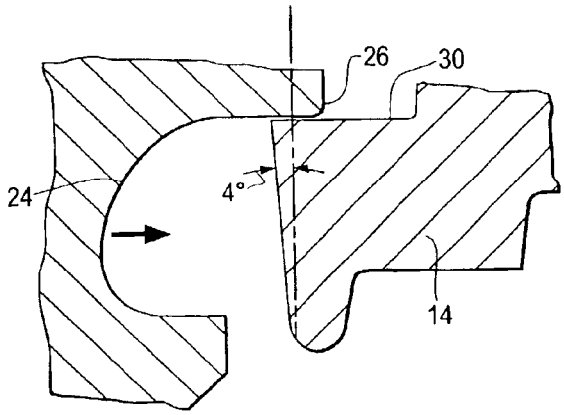
Fig. 1B Prior Art
Figure 1C:
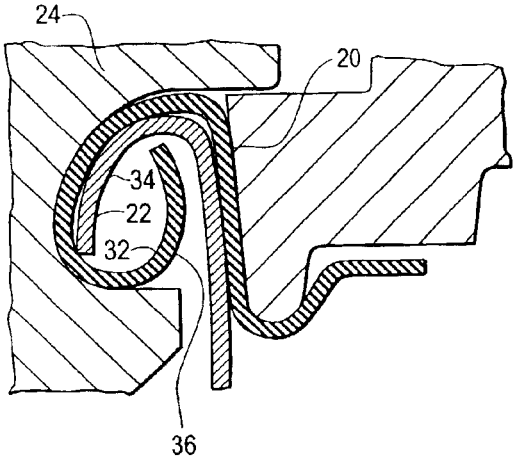
Fig. 1C Prior Art
Figure 1D:
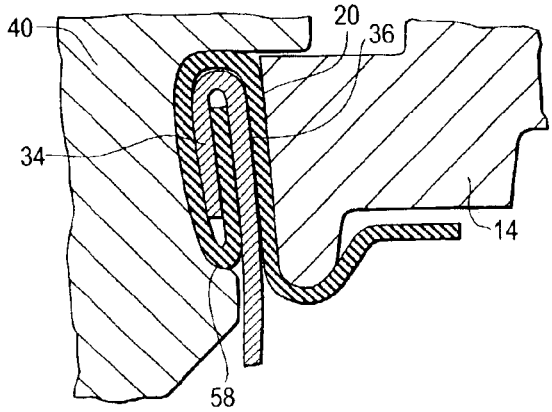
Fig. 1D Prior Art
Figure 2A:
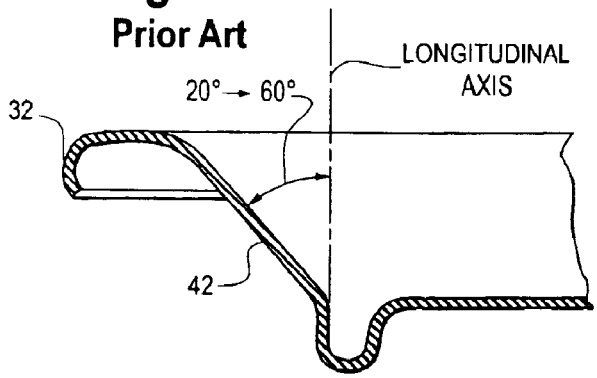
Fig. 2A Prior Art
FIG. 2A is a cross sectional view of a can end in accordance with U.S. Pat. No. 6,065,634.
Figure 7:
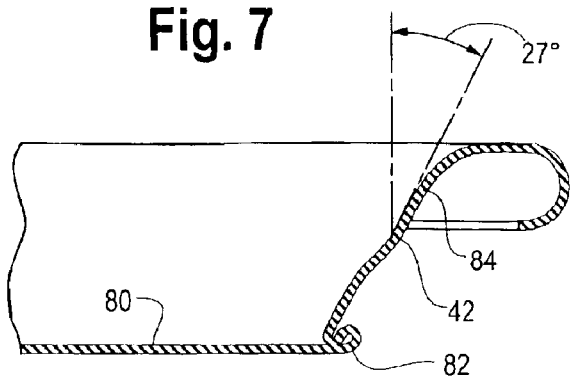
FIG. 7 shows an alternative end than can be used in conjunction with the seaming apparatus of this invention.

FIG. 7 shows an alternative end than can be used in conjunction with the seaming apparatus of this invention. The can end includes a flat panel 80, a folded corner 82, and a chuck wall 42 having an upper portion 84 that is inclined relative to the longitudinal axis by an angle equal to 27 degrees as shown. A seaming chuck in accordance with the preferred embodiments of this invention may have an inclination angle α of perhaps 8 to 10 degrees and a seaming roll inclination angle β of 8 to 14 degrees. After double seaming, the resulting seam has acceptable buckle strength. The seaming apparatus described herein would be also highly advantageous for use with the end shown in FIG. 2A. Generally speaking, the invention is ideal for use with can ends in which the chuck wall angle is inclined at an angle greater than 25 degrees, such as for example ends in which the chuck wall is inclined at an angle between 25 and 60 degrees. With greater chuck wall inclination angles, greater values of α and β may be required. However, as these values increase beyond say 15 degrees, the overall diameter of the can end increases which may make it difficult to install plastic rings over the ends so as to connect six cans together in a six-pack configuration, and other issues come into play such as stackability of the can ends.

The table below shows experimental results of buckle strength of cans seamed in accordance with this invention, for various combinations of the chuck anvil angle and the seaming surface inclination angle. Ten cans were used in each combination of chuck angle and seaming roll angle. The ends were of the type shown in FIG. 7. In each case, the values for the seaming surface inclination angle (β) is obtained by adding an angle of rotation of the surface about a point where the lower edge of the surface intersects the adjacent lip portion R2 of the roll to the base inclination of the surface in the nominal or original configuration (here +2 degrees). The same values can also be obtained from measurement of the inclination of the chord intersecting the seaming surface at its upper and lower edges, or from measurements of the offset of the center of the surface from a horizontal line drawn from the center of curvature, as shown in FIG. 6E.

From the table, the best results in terms of buckle strength were obtained when the chuck anvil inclination angle α ("chuck angle") is between 8 and 12 degrees, and the seaming roller inclination angle β ("roll angle") is between 10 and 14 degrees. In the table, the buckle strength units are pounds per square inch (PSI). 90 PSI is considered the minimum acceptable buckle strength for aluminum cans containing beverages under pressure. For best results, the seam is not too tight, as a too-tight seam can cause metal thinning in the can body at the double seam.

TABLE 1

| Chuck Angle/Roll Angle | |
|---|---|
| 6° | 4° |
| Avg. Buckle Strength 95.7 | |
| Chuck Angle/Roll Angle | |
| 8° | 6° |
| Avg. Buckle Strength 96.1 | |
| Chuck Angle/Roll Angle | |
| 10° | 8° |
| Avg. Buckle Strength 95.0 | |
| Chuck Angle/Roll Angle | |
| 12° | 10° |
| Avg. Buckle Strength 98.2 | |
| Chuck Angle/Roll Angle | |
| 10° | 10° |
| Avg. Buckle Strength 96.0 | |
| Chuck Angle/Roll Angle | |
| 8° | 10° |
| Avg. Buckle Strength 100.3 | |
| Chuck Angle/Roll Angle | |
| 6° | 8° |
| Avg. Buckle Strength 97.0 | |
| Chuck Angle/Roll Angle | |
| 12° | 14° |
| Avg. Buckle Strength 100.9 | |
| Chuck Angle/Roll Angle | |
| 10° | 12° |
| Avg. Buckle Strength 100 | |
| Chuck Angle/Roll Angle | |
| 10° | 14° |
| Avg. Buckle Strength 99.2 | |
| Total Average Buckle Strength = 97.8 | |

Further testing was performed on a combination of a variety of seam roll angles and chuck anvil angles, and a presently preferred embodiment uses a chuck anvil angle of 10 degrees, a second roll with a rotation angle of 10 degrees (total angle 12 degrees as measured using the techniques described above and with a 2 degree inclination at the nominal or zero rotation angle), seam thickness or width of 0.044 inches, chuck anvil radius of 0.015 inches (radius $R_C$ at the bottom of the chuck anvil wall, FIG. 4). Very little variation in buckle strength was observed for anvil/seaming roll values between 4 and 12 degrees. In the further testing it was observed that, in general, buckle strength increased with a looser seam and greater seam thickness. Preferred ranges for seam thickness are 45–47 thousandths of an inch. Tighter seams, below 42 thousandths, might tend to produce thinning of the can body wall, which decreases buckle strength. It was also observed that while the nominal chuck anvil radius ($R_C$ in FIG. 4) of 0.015 inches gave the best results, larger radii were better, and that small radius values with large anvil angles were unacceptable.

It was further observed that with larger chuck wall inclination angles in the can end, there is less springback in the metal after seaming, tending to reduce the seam gap. Thus, for can ends that have say a 20–60 degree chuck wall angle, a loose seam, with a larger chuck anvil angle (such as 12 degrees) would produce a seam with adequate buckle strength to meet customer requirements.

From the foregoing, and with reference to FIG. 4, it will be appreciated that we have described a method for joining a can body to a can end. The method includes the step of placing the can end 10 over the can body 12 and receiving a seaming chuck 14 in the can end. The chuck has an anvil portion and a peripheral upper anvil wall 20. The upper anvil wall 20 is inclined relative to the longitudinal axis of the can body at an angle α greater than 6 degrees. The method continues with a step of performing a seaming operation on the can end and can body with a seaming roll 24. The seaming roll has a seaming surface 52 for engaging the peripheral curl 32 in a seaming operation to compress the peripheral curl against the peripheral flange and peripheral upper anvil wall to form a seal between the can end and the can body. The seaming surface and the upper anvil wall of the chuck are constructed and arranged such that the seaming surface is inclined relative to the longitudinal axis by an angle β, wherein β is greater than about 4 degrees, and wherein β=α±up to 4 degrees. Furthermore, the seam thickness is such that it is not too tight, i.e., there is a minimal amount, if any, from thinning of the metal in the can body that would weaken the buckle strength of the can.

In still another aspect, we have described an improvement to a can construction having a can end, a can body defining a longitudinal axis, and a seam joining said can end to said can body, the improvement comprising the end having a chuck wall inclined at an angle of greater than 20 degrees prior to seaming of the can end to the can body, and the seam is inclined relative to the longitudinal axis of the can body by an amount greater that 6 degrees. This inclination amount is expected to be nearly equal to the chuck anvil angle. In practice, the inclination of the seam angle may actually increase a degree or two after seaming. For example, with a can end having a chuck wall inclined at an angle of 25 degrees and seamed to a can body with a chuck angle of 10 degrees and a seaming roller of 12 degrees, the resulting seamed end/can may have a seam angle of 10 to 12 degrees, depending on the amount of springback in the metal. To form such a seam, the roll and chuck are positioned relative to each other such that the seam is loose enough to have the improved buckle strength (e.g., 46 or 47 thousandths of an inch seam width) and is not to tight so as to cause any thinning of metal in the can body due to the seam. The resulting can would be expected to have buckle strength of roughly 100 PSI, which is considerably in excess of the 90 PSI minimum acceptable buckle strength current industry standard.

The above discussion of seam dimensions (e.g., seam width or thickness) has been for 202 can ends (2 2/16 diameter ends) at 0.0084 inch gauge metal (aluminum) for the end stock thickness. With different size cans and different gauge metal, the thickness of the seam may depart from the described ranges. Nevertheless, a relatively loose seam will be preferred for such other sizes and gauges; that is, one in which the seam width is tight enough to provide sufficient buckle strength, but not so tight so as to produce a thinning of the metal in the can body at the double seam.

Variation from the disclosed embodiments may be made without departure from the true scope and spirit of the invention. This scope can be found by reference to the appended claims, interpreted in light of the foregoing.

We claim:

1. An apparatus for forming a seam joining a can end to a metal can body, said can end having a peripheral curl, said can body defining a longitudinal axis and having a peripheral flange, comprising:

a seaming chuck received by said can end when said can end is placed over said can body to join the can body and can end together, said chuck having an anvil portion and a peripheral anvil wall, wherein said anvil wall is inclined relative to said longitudinal axis at an angle α greater than or equal to about 6 degrees; and a seaming roll having a seaming surface for engaging said peripheral curl in a seaming operation to compress said peripheral curl against said peripheral flange and said peripheral anvil wall to form a seam therebetween;

wherein said seaming surface is inclined relative to said longitudinal axis by an angle β, wherein β is greater than or equal to about 4 degrees, and wherein the value of angle β=α± up to about 4 degrees;

and wherein said seaming roll and seaming chuck are arranged relative to each other such that said seam is formed such that thinning of the metal in said can body due to the formation of said seam is substantially avoided.

2. The apparatus of claim 1, wherein the value of a is between 6 and 14 degrees and wherein the value of β is between 4 and 14 degrees.

3. The apparatus of claim 2, wherein the value of a is between 8 and 12 degrees, and wherein the value of β is between 10 and 14 degrees.

4. The apparatus of claim 3, wherein the value of β substantially equals α=2 degrees.

5. The apparatus of claim 3, wherein said can body and can end comprise the body and end of an aluminum beverage can.

6. The apparatus of claim 1, wherein β≧α, and β and β are within 3 degrees of each other.

7. The apparatus of claim 1 wherein the seaming surface comprises a curved surface having a cross-sectional profile having upper and lower peripheral points at which said curved surface transitions to adjacent surfaces of said seaming roll, and wherein the measurement of the inclination of said seaming surface is measured by constructing a chord on said profile connecting said upper and lower points and measuring the inclination of said chord relative to the longitudinal axis.

8. The apparatus of claim 1 wherein the seaming surface comprises a curved surface having a cross-sectional profile and a center of curvature, and wherein the measurement of the inclination of said seaming surface is measured by constructing a line from the center of curvature to a midpoint of said profile and measuring the angle between said line and a second line from said center of curvature intersecting said profile that is perpendicular to the longitudinal axis.

9. The apparatus of claim 1, wherein the seaming roll comprises a curved surface having a profile having upper and lower peripheral points at which said curved surface transitions to adjacent surfaces in said seaming roll, and wherein the inclination of said curved surface of said seaming roll is formed by constructing an arc having the same profile as said curved surface in a first orientation; rotating said arc about a point proximate to said lower peripheral point to form the inclination angle β, and shaping said roll with said curved surface according to said arc as rotated.

10. The apparatus of claim 1, wherein said seaming surface comprises a substantially flat surface.

11. The apparatus of claim 1, wherein can end further defines a central axis and further comprises a chuck wall, and wherein said chuck wall, prior to placement of said can end over said can body, is inclined at an angle of between 20 and 60 degrees relative to the central axis of said can end.

12. A method of joining a metal can body to a can end, said can end having a peripheral curl, said can body defining a longitudinal axis and having a peripheral flange, comprising the steps of:

placing the can end over the can body;

receiving a seaming chuck in said can end, said chuck having an anvil portion and a peripheral upper anvil wall, wherein said upper anvil wall is inclined relative to said longitudinal axis at an angle α greater than 6 degrees; and performing a seaming operation on said can end and can body with a seaming roll to form a seam, said seaming roll having a seaming surface for engaging said peripheral curl in a seaming operation to compress said peripheral curl against said peripheral flange and peripheral upper anvil wall to form a seam between said can end and said can body;

wherein said seaming surface is inclined relative to said longitudinal axis by an angle $\beta$, wherein $\beta$ is greater than about 4 degrees, and wherein $\beta=\alpha\pm$up to about 4 degrees; and wherein said seaming roll and seaming chuck are arranged relative to each other such that said seam is formed such that thinning of the metal in said can body is substantially avoided.

13. The method of claim 12, wherein the value of $\alpha$ is between 6 and 14 degrees and wherein the value of $\beta$ is between 6 and 14 degrees.

14. The method of claim 12, wherein $\beta>\alpha$, and wherein $\beta$ and $\alpha$ are within 3 degrees of each other.

15. The method of claim 12, wherein the value of $\alpha$ is between 8 and 12 degrees, and wherein the value of $\beta$ is between 10 and 14 degrees.

16. The method of claim 15, wherein the value of $\beta$ substantially equals $\alpha=2$ degrees.

17. The method of claim of claim 15, wherein said can body and can end comprise the body and end of an aluminum beverage can.

18. The method of claim 12, wherein said can body and can end comprise the body and end of an aluminum beverage can.

19. The method of claim 12, wherein said can end further defines a central axis and further comprises a chuck wall, and wherein said chuck wall, prior to placement of said can end over said can body, is inclined at an angle of between 20 and 60 degrees relative to the central axis of said can end.

20. The method of claim 12, wherein said seam has a seam thickness of between 0.044 and 0.047 inches.

21. An apparatus for use in forming a seam joining a can end to a can body, said can end having a peripheral curl, said can body defining a longitudinal axis and having a peripheral flange, comprising:

a seaming roll having a seaming surface adapted for engaging said peripheral curl in a seaming operation to compress said peripheral curl against said peripheral flange and against a seaming chuck to form a seam therebetween;

wherein said seaming surface is inclined relative to said longitudinal axis by an angle $\beta$ of between 6 and 14 degrees; and wherein the seaming surface comprises a curved surface having a cross-sectional profile having upper and lower peripheral points at which said curved surface transitions to adjacent surfaces of said seaming roll, and wherein the measurement of the inclination of said seaming surface is measured by constructing a chord on said profile connecting said upper and lower points and measuring the inclination of said chord relative to the longitudinal axis.

* * * * *

UNITED STATES PATENT AND TRADEMARK OFFICE

CERTIFICATE OF CORRECTION

PATENT NO. : 6,915,553 B2
DATED : July 12, 2005
INVENTOR(S) : Turner et al.

It is certified that error appears in the above-identified patent and that said Letters Patent is hereby corrected as shown below:

Column 10,
Lines 8 and 11, delete "a" and replace it with -- α --.
Line 15, delete "=" and replace it with -- + --.
Line 19, delete the phrase "and β and β" and replace it with -- and β and α --.

Column 11,
Line 23, delete "=" and replace it with -- + --.
Line 27, delete "12" and replace it with -- 11 --.

Signed and Sealed this

Sixth Day of December, 2005

JON W. DUDAS
*Director of the United States Patent and Trademark Office*